US010076169B2

(12) United States Patent
Clough

(10) Patent No.: US 10,076,169 B2
(45) Date of Patent: Sep. 18, 2018

(54) TOTE ASSEMBLY WITH INTERCHANGEABLE FREE STANDING INSERTS

(71) Applicant: Michael J. Clough, East Amherst, NY (US)

(72) Inventor: Michael J. Clough, East Amherst, NY (US)

( * ) Notice: Subject to any disclaimer, the term of this patent is extended or adjusted under 35 U.S.C. 154(b) by 132 days.

(21) Appl. No.: 15/142,482

(22) Filed: Apr. 29, 2016

(65) Prior Publication Data

US 2017/0006987 A1 Jan. 12, 2017

Related U.S. Application Data

(60) Provisional application No. 62/189,984, filed on Jul. 8, 2015.

(51) Int. Cl.

| | |
|---|---|
| ***B65D 1/38*** | (2006.01) |
| ***A45C 13/02*** | (2006.01) |
| ***A45C 5/04*** | (2006.01) |
| ***A45C 13/10*** | (2006.01) |
| ***A45C 5/08*** | (2006.01) |
| ***A45C 3/10*** | (2006.01) |
| ***A45C 5/02*** | (2006.01) |
| ***A45C 13/00*** | (2006.01) |

(52) U.S. Cl.

CPC ..... *A45C 13/02* (2013.01); *A45C 3/10* (2013.01); *A45C 5/02* (2013.01); *A45C 5/045* (2013.01); *A45C 5/08* (2013.01); *A45C 13/008* (2013.01); *A45C 13/1069* (2013.01); *A45C 2005/10* (2013.01); *A45C 2013/026* (2013.01)

(58) Field of Classification Search

CPC .. A45C 13/02; A45C 3/00; A45C 5/00; A45C 3/02; A45C 3/004

USPC ..... 190/110, 109, 100, 103; 206/316.2, 373; 312/213, 219; 220/23.87, 23.91, 668

See application file for complete search history.

(56) References Cited

U.S. PATENT DOCUMENTS 1,251,404 A 12/1917 Mills
4,949,842 A * 8/1990 Mokiao, II ..... A45C 3/00 206/278
4,979,833 A 12/1990 Cook
5,011,013 A * 4/1991 Meisner ..... B25H 3/023 206/373

(Continued)

FOREIGN PATENT DOCUMENTS

WO 1998038884 A1 9/1998
WO 2013144990 A1 10/2013

OTHER PUBLICATIONS

International Search Report and Written Opinion in corresponding International Application No. PCT/US2016/041519, dated Oct. 4, 2016.

(Continued)

*Primary Examiner* — Fenn C Matthew
*Assistant Examiner* — Cynthia Collado
(74) *Attorney, Agent, or Firm* — Brian B. Shaw, Esq.; Harter Secrest & Emery LLP

(57) ABSTRACT

A tote assembly is provided having a basket and an insert sized to be slideably received within the basket. The insert can be one of a plurality of inserts, each sized to be slideably received within the basket wherein the inserts can have different interior dividers to define compartments for accessories or equipment associated with a particular activity.

20 Claims, 16 Drawing Sheets

(56) References Cited

U.S. PATENT DOCUMENTS

| | | | | |
|---|---|---|---|---|
| 5,118,173 | A * | 6/1992 | Proctor | D06F 95/002 220/23.88 |
| 5,794,747 | A | 8/1998 | Bryant | |
| 5,983,464 | A | 11/1999 | Bauer | |
| 6,070,628 | A | 6/2000 | Nastasi | |
| 6,386,414 | B1 | 5/2002 | Kilduff | |
| 6,561,329 | B2 | 5/2003 | Stobbs, II et al. | |
| 7,610,944 | B2 | 11/2009 | Reiter | |
| 7,806,309 | B2 | 10/2010 | Korchmar | |
| 8,225,829 | B2 | 7/2012 | Melamed | |
| 8,408,791 | B1 | 4/2013 | Wang | |
| D805,582 | S * | 12/2017 | Melnick | D19/90 |
| 2006/0037824 | A1* | 2/2006 | Park | A45C 13/03 190/110 |
| 2006/0182369 | A1 | 8/2006 | Schneider | |
| 2006/0256546 | A1 | 11/2006 | Amaral | |
| 2008/0223677 | A1 | 9/2008 | Mauro | |
| 2009/0101254 | A1* | 4/2009 | Vaccarella | A45C 13/26 150/108 |
| 2009/0294237 | A1* | 12/2009 | Sisitsky | A45C 1/024 190/103 |
| 2010/0032431 | A1* | 2/2010 | Schatz | D06F 95/002 220/23.87 |
| 2010/0259139 | A1* | 10/2010 | Tussy | A45C 5/02 312/213 |
| 2011/0005646 | A1* | 1/2011 | Nelson | A45C 1/024 150/103 |
| 2011/0000590 | A1 | 6/2011 | Welch | |
| 2011/0265289 | A1 | 11/2011 | Wu | |
| 2012/0128273 | A1 | 5/2012 | Lytle | |
| 2013/0200762 | A1* | 8/2013 | Schleicher | A47B 71/00 312/213 |
| 2013/0216158 | A1 | 8/2013 | Meldeau | |
| 2014/0158737 | A1 | 6/2014 | Koutouras et al. | |
| 2014/0198442 | A1 | 7/2014 | Rekuc et al. | |
| 2014/0326560 | A1* | 11/2014 | Bergh | A45C 11/38 190/110 |
| 2014/0352858 | A1 | 12/2014 | Dewitt | |
| 2014/0367397 | A1* | 12/2014 | Audet | D06F 95/002 220/668 |

OTHER PUBLICATIONS https://www.amazon.com/Rubbermaid-Laundry-Hamper-2-2-Bushel-FG260004ROYBL/dp/B002IOEFXO.
http://shop.nordstrom.com/s/she-lo-next-chapter-bucket-bag/3877457.
http://www.forzieri.com/handbags/carven/ae130414-022-01.

* cited by examiner

TOTE ASSEMBLY WITH INTERCHANGEABLE FREE STANDING INSERTS

STATEMENT REGARDING FEDERALLY SPONSORED RESEARCH OR DEVELOPMENT

Not applicable.

REFERENCE TO A "SEQUENCE LISTING"

Not applicable.

BACKGROUND OF THE INVENTION

Field of the Invention

The present disclosure relates to totes and more particularly to a tote assembly having an outer basket that can cooperatively engage any of a plurality of interchangeable inserts. The inserts can be configured for accessories or equipment associated with a particular activity, and any of the plurality of inserts can be operatively engaged by the basket.

BRIEF SUMMARY OF THE INVENTION

In one configuration, a tote assembly is provided having a basket having a basket bottom and a basket sidewall projecting from a periphery of the basket bottom and terminating at a basket open end, the basket sidewall including a plurality of basket apertures, the basket sidewall having a basket sidewall upper portion and a basket sidewall lower portion, the basket bottom and the basket sidewall lower portion formed of a water resistant material, the basket sidewall upper portion defining a pair of opposing handles, each handle at least partly defined by a corresponding handle aperture, the basket bottom and the basket sidewall configured to maintain an upright free standing orientation; and an insert sized to be slidably received within the basket to be disposed in operable engagement with the basket, the insert including an insert bottom having a plurality of apertures and an insert sidewall projecting from a periphery of the insert bottom, the insert sidewall terminating at an insert open end and including a plurality of insert apertures, the insert apertures being aligned with the basket apertures upon operable engagement of the insert and the basket.

DETAILED DESCRIPTION OF THE INVENTION

Figure 1:
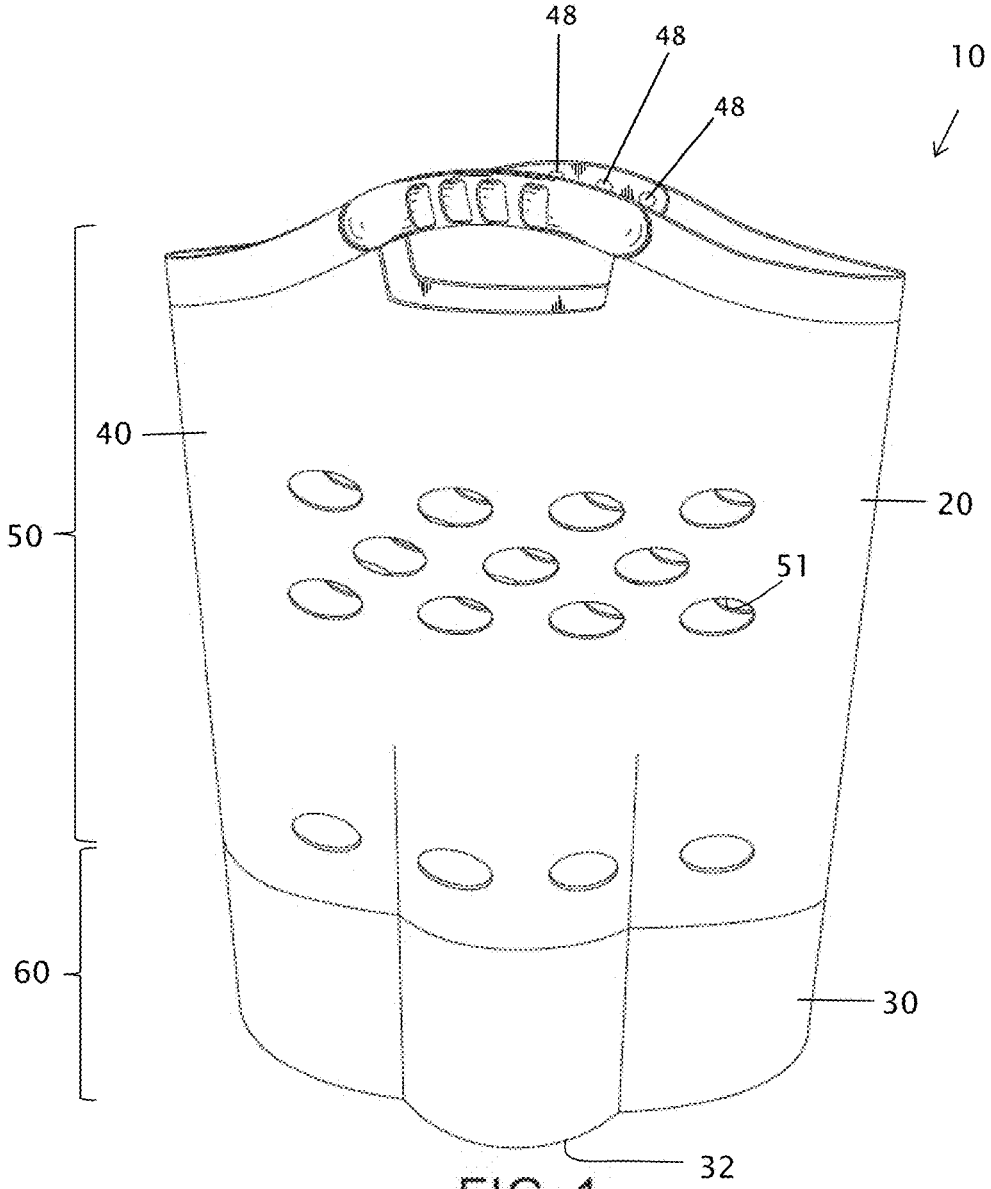
FIG. 1 is a side perspective view of a basket of the tote assembly.

Referring to FIGS. 2, 4, 6, 8, 10 and 11, the present tote assembly 10 includes a basket 20 and at least one insert 80, and in select configurations, a plurality of interchangeable inserts.

The basket 20 includes a basket bottom 30 and a basket sidewall 40.

In one configuration, the basket bottom 30 includes a plurality of lobes 32 which define a portion of a footprint of the basket 20 and a contact area with a support surface. The lobes 32 are sized to define dimensions along a major axis and a perpendicular minor axis sufficient to maintain the basket 20 (and tote assembly 10) in a free standing, self-supporting upright position.

Figure 2:
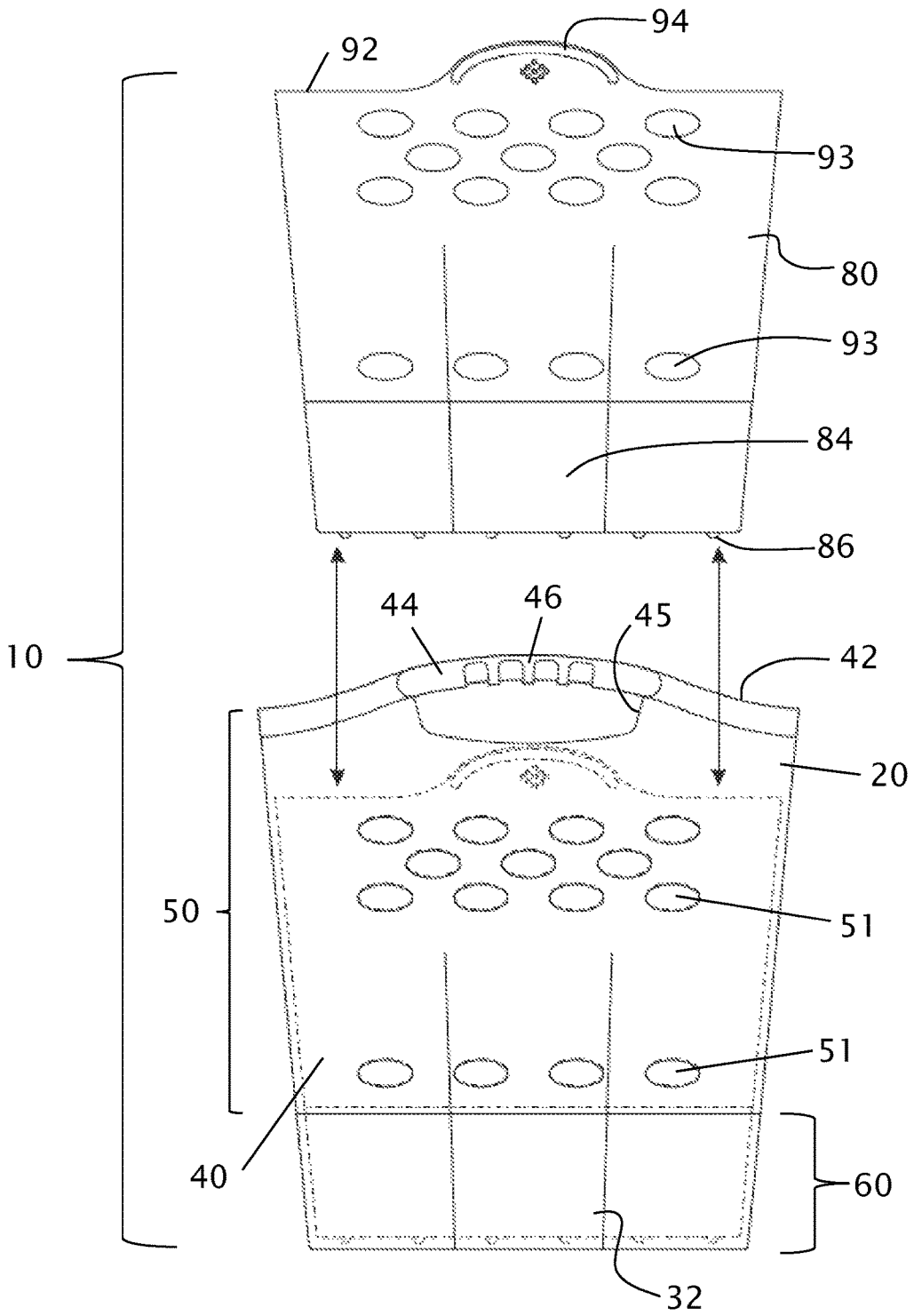
FIG. 2 is a side elevational view showing the engagement and separation of an insert from the basket.
Figure 11:
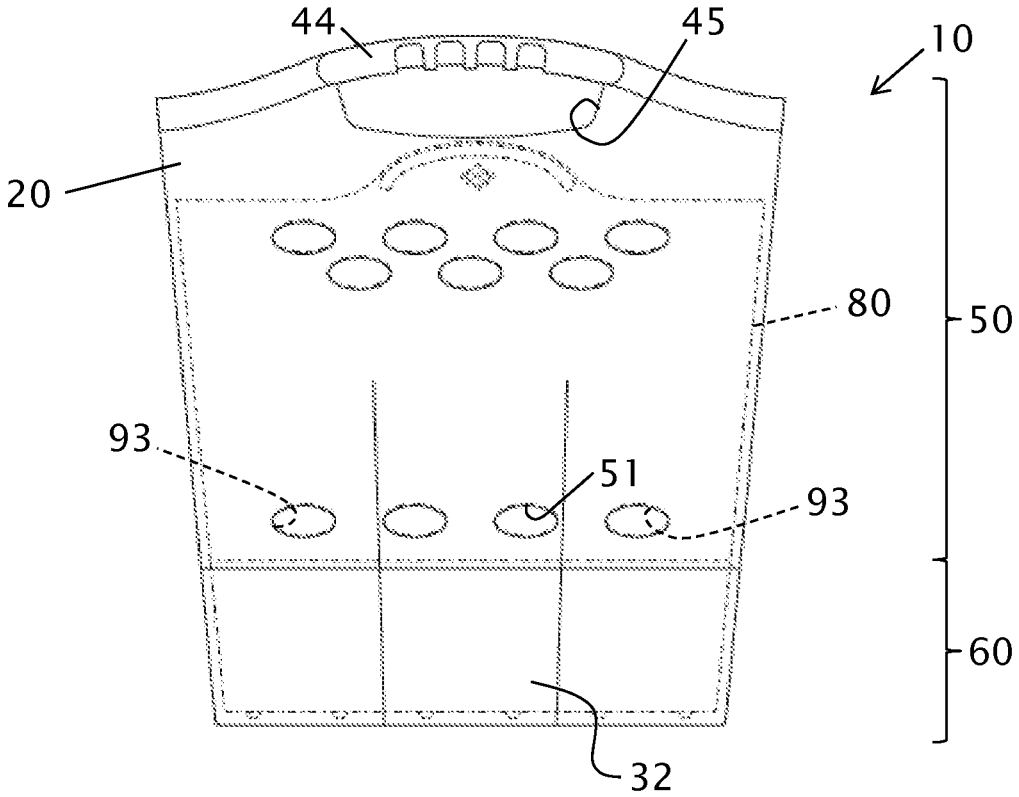
FIG. 11 is a side elevational view showing the insert operatively received within the basket.
Figure 13:
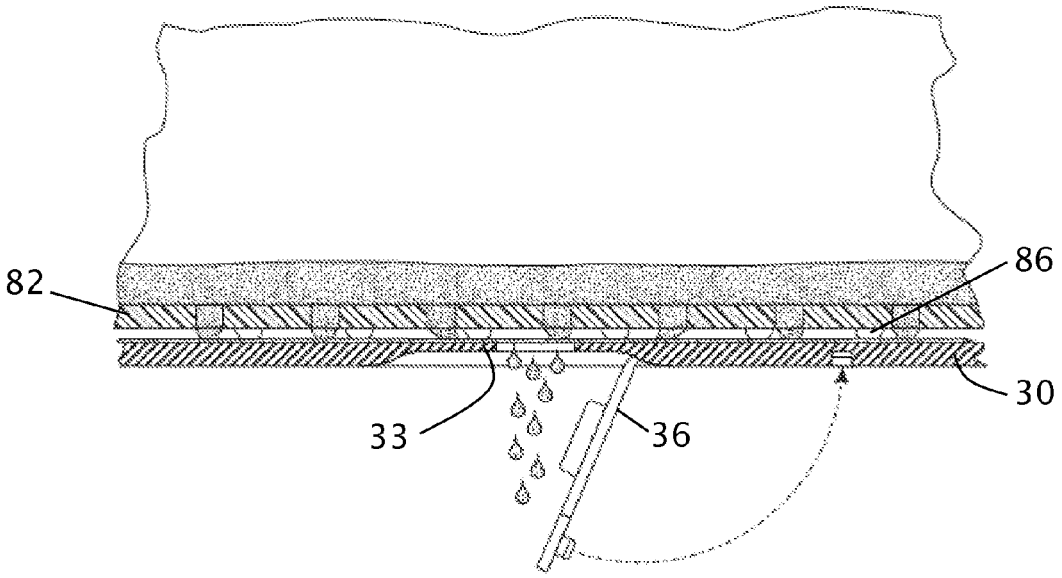
FIG. 13 is a partial side elevational view of the insert cooperatively engaged with the basket and the basket drain port in an open configuration, with liquid draining from the insert through the open drain port.

In the configurations of FIGS. 2, 11 and 13, an outside surface of the basket bottom 30 defines the contact surface for the tote assembly 10.

The basket sidewall 40 extends from a periphery of the basket bottom 30 and extends upward to terminate at a free edge 42, the free edge defining an opening of the basket 20. The periphery of the basket bottom 30 is configured to provide the basket 20 as a stable, self-standing component.

As seen in FIGS. 1, 2 and 11, the basket sidewall 40 includes a basket sidewall upper portion 50 and a basket sidewall lower portion 60, wherein the lower portion and the basket bottom 30 define a watertight base. The basket sidewall upper portion 50 can include a plurality of apertures 51 sized to enhance airflow there thorough. In one configuration, the plurality of apertures 51 in the basket sidewall upper portion 50 include a first set and a second set, where the first set and the second set are generally on opposing portions of the sidewall and aligned so as to facilitate or promote air flow through. Specifically, as seen in FIGS. 1, 2, 4, 6, 8 and 10, the apertures 51 can be located in the basket sidewall 40 along the portion of the basket sidewall generally extending along the major axis. That is, the sets of apertures are spaced apart along the minor axis.

It is also contemplated that a pair of the apertures 51 can be located proximal to the free edge 42 and sized to cooperatively receive a standard carrying or shoulder strap, having a width of between approximately 1 inch to 3 inches.

The free edge 42 of the basket sidewall 40 defines a pair of opposing handles 44, wherein each handle is at least partly defined by a corresponding handle aperture 45.

In one configuration, the handles 44 include an overmold to produce a thickening of material forming an ergonomic grip for engaging the hand of a user. Alternatively, grips 46 of the handles 44 can be formed by separately molded grips which are subsequently attached to the basket sidewall 40. Thus, the grips 46 of the handles 44 can be of a contrasting, complimentary or same color as an adjacent portion of the basket 20.

Figure 14:
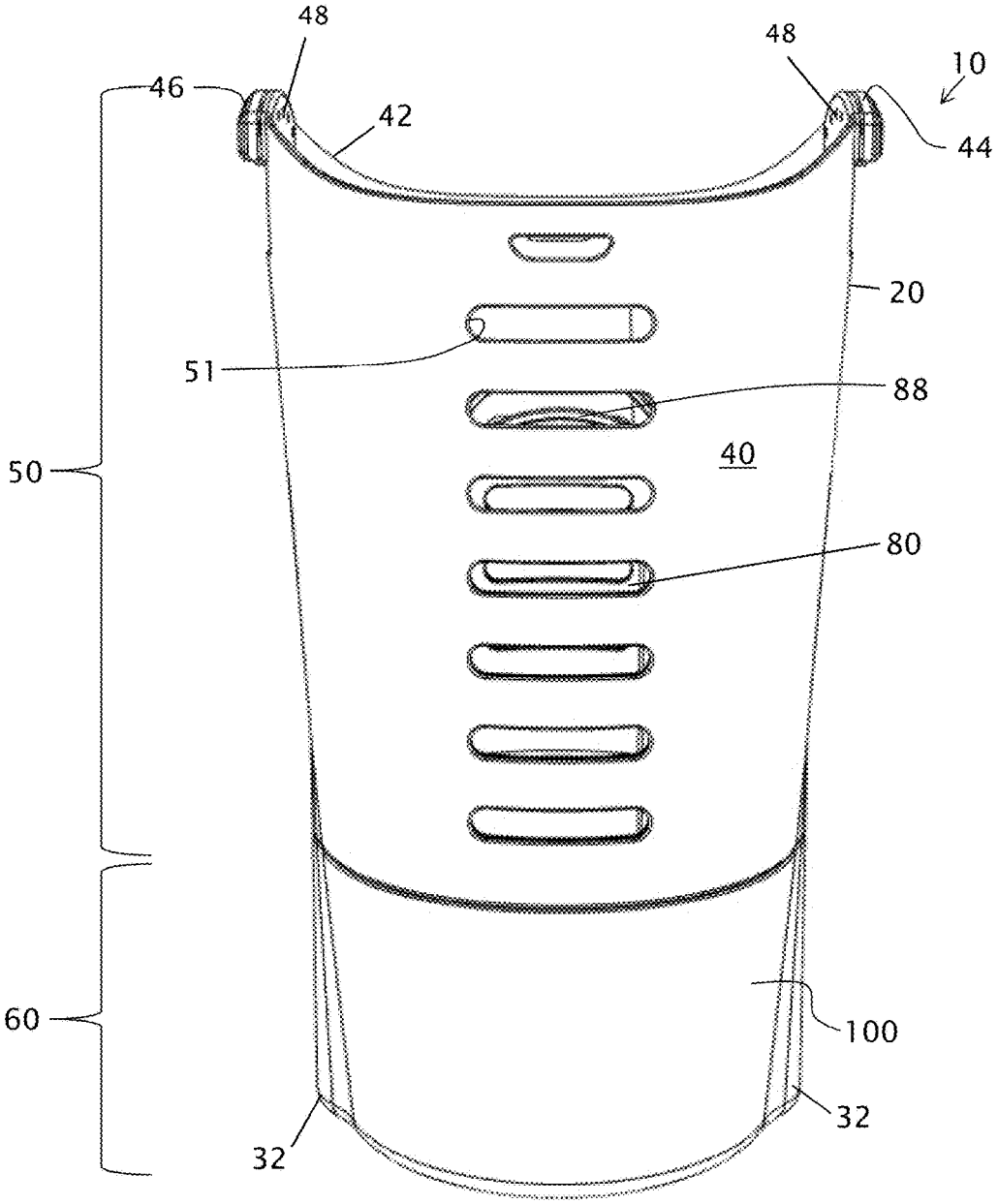
FIG. 14 is a first side elevational view of a further configuration of the tote assembly.
Figure 15:
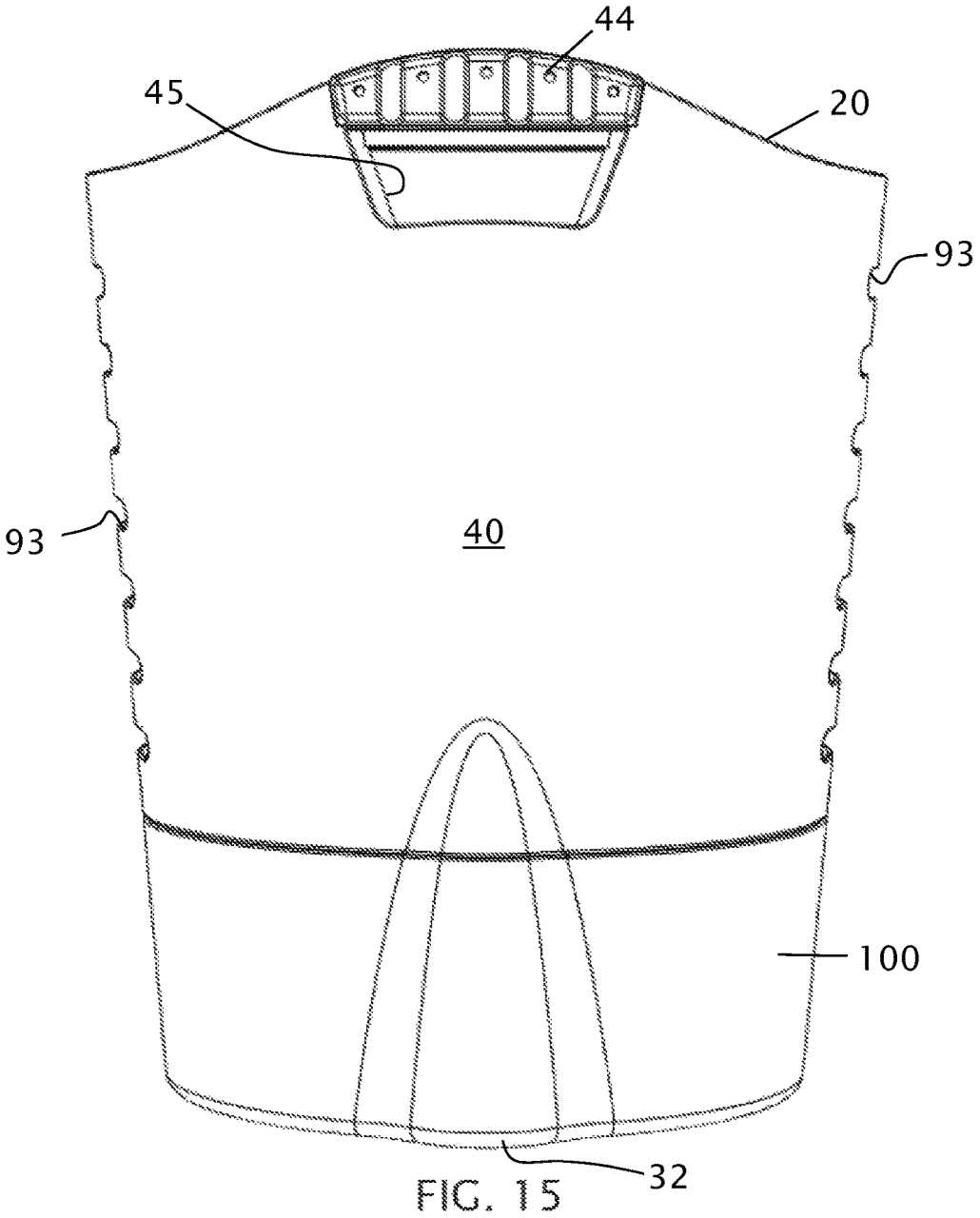
FIG. 15 is a second side elevational view of the further configuration of the tote assembly.
Figure 17:
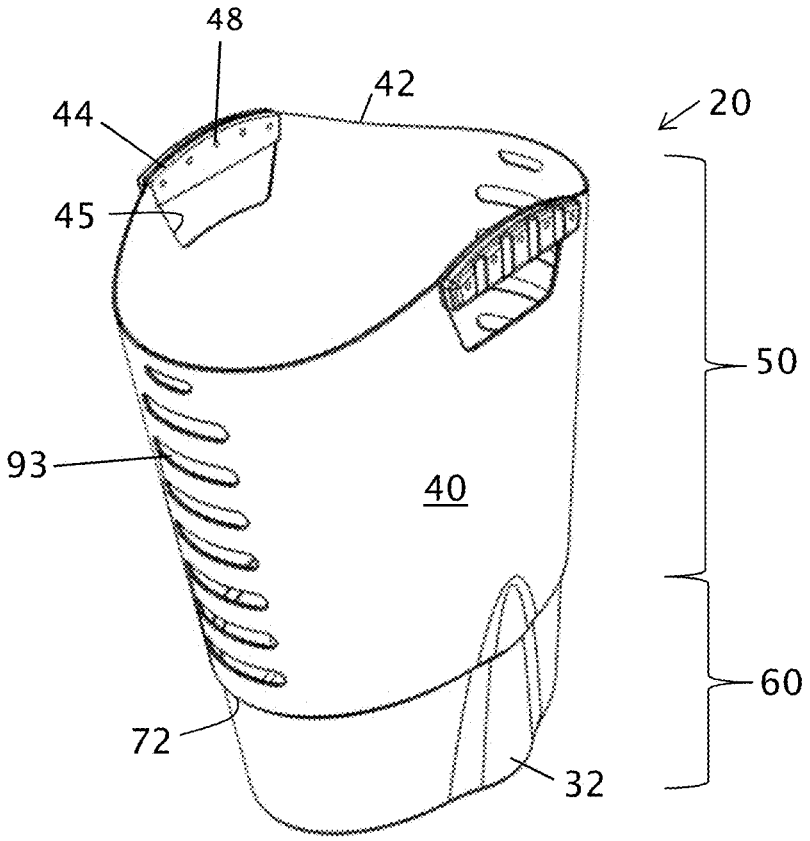
FIG. 17 is a perspective view of a basket of the further configuration of the tote assembly.

In further configurations, opposing portions of the basket sidewall upper portion 50 or handles 40 can include a plurality of fasteners such as clips, detents, hook and loop fasteners or magnets 48 as seen referenced in FIGS. 1, 14 and 17 for releasably engaging to selectively close or open the basket and hence the insert 80. For example, as the free edge 42 defines a generally curvilinear periphery such as but not limited to elliptical, obround, or oval, the fasteners are disposed on opposite ends of the minor axis, thereby closing the basket along a direction perpendicular to the major axis.

In one configuration, the basket sidewall 40 defines a tapered profile from the open end defined by the free edge 42 to the periphery of the basket bottom 30 such that a plurality of baskets 20 can be nested together.

In a further configuration, the basket bottom 30 can include a drain port 33 and a drain plug 36 for selectively closing the drain port. It is contemplated the drain plug 36 can be tethered to the basket bottom 30 to reduce unintended separation of the drain plug from the basket bottom. As set forth below, the drain plug 36 can be releasably retained to selectively occlude the drain port 33 and can be any of a variety of mechanisms including but not limited to interference fit, twist and lock, bayonet or threads.

In one configuration, it is contemplated the basket sidewall upper portion 50 is a different material than the basket sidewall lower portion 60 and the basket bottom 30. For example, the basket sidewall upper portion 50 may be a pliable, self-supporting plastic, while the basket sidewall lower portion 60 is a rubberized material, typically of a greater density and rigidity than the basket sidewall upper portion. It is contemplated the basket sidewall 40 can be formed of a common material.

Further, as seen in the Figures, the periphery of the basket sidewall 40 transitions from the periphery of the basket bottom 30 to a generally oval or elliptical periphery at the free edge 42 of the basket sidewall 40.

The insert 80 is sized to be slidably received within the basket 20 to an operable engagement. In the operable engagement, a portion of the interior surface of the basket sidewall 40 contacts an exterior surface of the insert 80. While it is contemplated that a coupling or interlock mechanism can be employed between the insert and the basket, such as detents or interference fits or resilient deformation, it is contemplated that in one configuration, the insert 80 will simply sit on the basket bottom 30 after being inserted into the basket 20.

The insert 80 includes an insert bottom 82 and an insert sidewall 90 projecting from a periphery of the insert bottom. The insert sidewall 90 terminates at an insert open end defined by a free edge 92. The insert bottom 82, or at least a portion of the insert bottom, includes a plurality of apertures or through holes 83.

The periphery of the insert bottom 82 corresponds to the periphery of the basket bottom 30, and thus can include a plurality of corresponding lobes 84. Thus, the insert bottom 82 and the free edge 92 each have a periphery which corresponds to the corresponding basket bottom 30 and the free edge 42, having a generally elliptical or oval shape defined by the major axis and the perpendicular minor axis.

The insert sidewall 90 includes a plurality of insert apertures 93, wherein the insert apertures are aligned with the basket apertures 51 upon operable engagement of the insert 80 and the basket 20. In one configuration, the apertures 93 have the same shape and size as the apertures 51.

The free edge 92 of the insert sidewall 90 defines or forms a grip or pair of grips or handles 94 for the user to engage the insert 80, independent of the basket 20. As seen in FIGS. 2 and 11, the handles 94 can be disposed along the minor axis as the handles 44 are located.

An outside surface of the insert bottom 82 includes a plurality of standoffs 86 sized to contact the basket bottom 30 upon operable engagement of the basket 20 and the insert 80. The standoffs 86 define a separation of the insert bottom 82 from the basket bottom 30, wherein the separation is sized to form a reservoir 87 for receiving a given volume of liquid. The standoffs 86 are sized to permit ready drainage from the insert 80 through the apertures 83 to the basket 20. Further, the standoffs 86 define a sufficient reservoir volume to accommodate anticipated drainage without soaking the contents retained in the insert 80.

In a further configuration, the insert sidewall 90 is sized to extend approximately 50% to 100% of the height of the basket sidewall 40.

In one configuration, the free edge 92 of the insert sidewall 90 terminates below a bottom of the handle aperture 45 in the basket sidewall 40, thereby permitting free passage of the user's hand through the handle aperture of the basket.

In select configurations, the insert 80 can include handles or grips 88 for the user to engage the insert. The handles 88 can be in the form of added material or handles formed by associated apertures. As seen in FIG. 2, the handles 88 can be correspondingly located to the handles 44 of the basket 20. That is, the handles 88 can be opposing and spaced apart along the minor axis.

The insert 80 has a correspondingly tapered insert sidewall 90 such that the insert is slidably received within the basket 20 and the standoffs 86 of the insert bottom 82 contact the basket bottom 30.

Further, upon operable engagement of the insert 80 and the basket 20, the plurality of apertures 93 in the insert sidewall 90 align with the first and second sets of the plurality of apertures 51 in the basket sidewall 40 to thereby facilitate air flow through the operably located insert.

Similar to the basket 20, the insert bottom 80 and the insert sidewall 90 are configured to provide a self-standing upright configuration. The lobes 32 of the basket bottom 30 and the lobes 84 of the insert bottom 80, in conjunction with the respective sidewalls, provide a stable, self-standing configuration of the tote assembly 10.

It is anticipated the basket 20 may have an approximate 27 inch height, wherein the insert has a height of approximately 23-24 inches.

Figure 3:
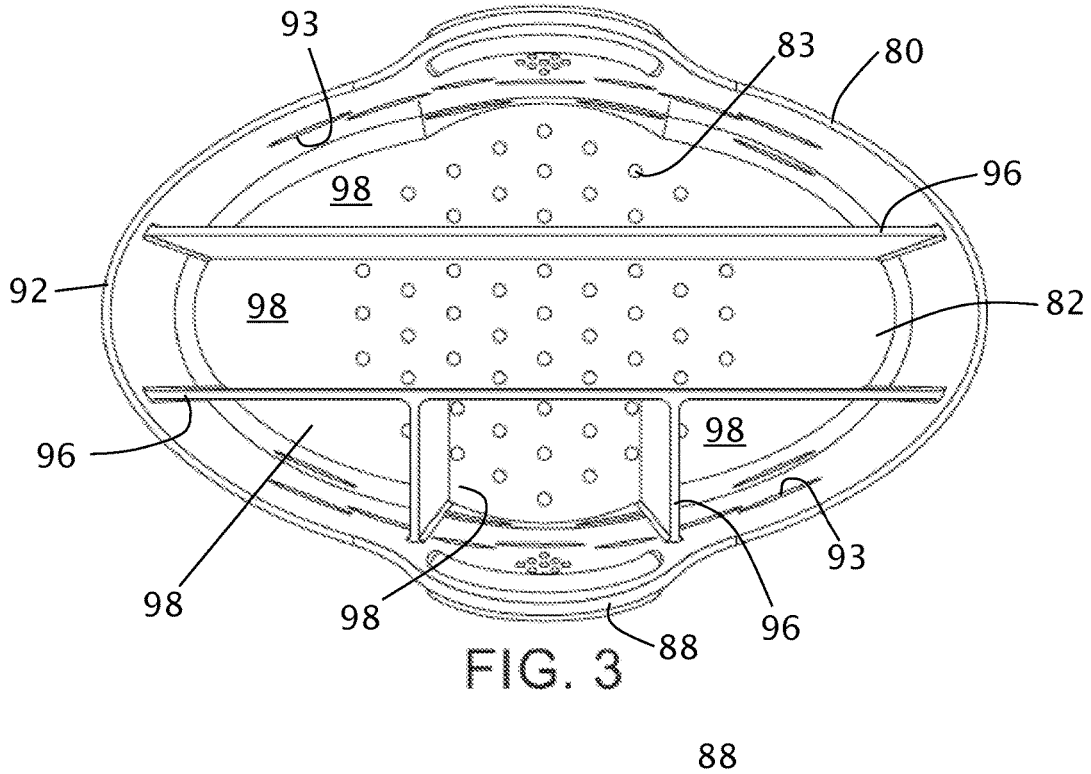
FIG. 3 is a top plan view of a first configuration of the insert.
Figure 4:
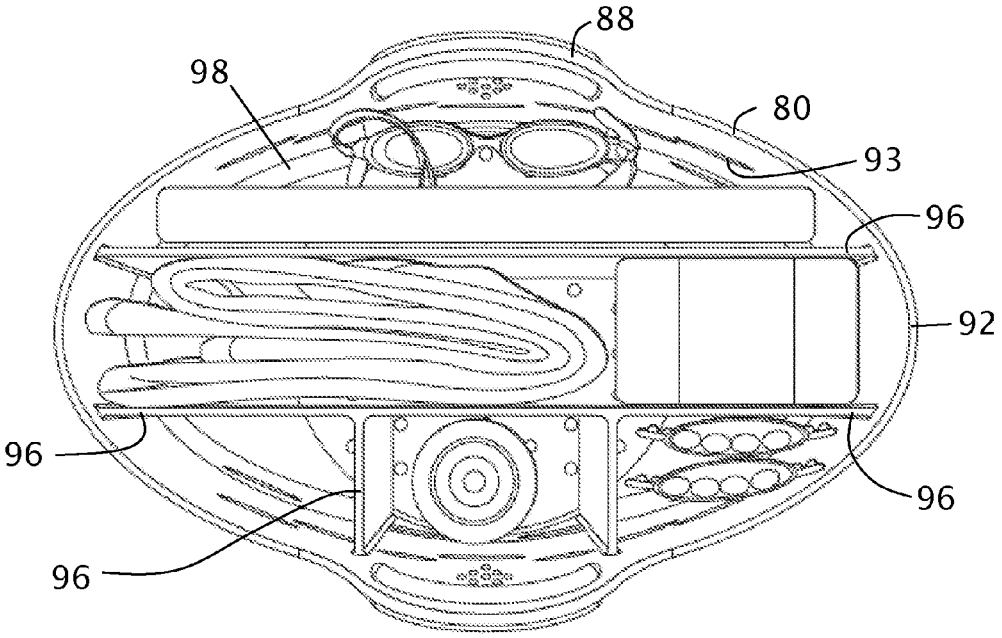
FIG. 4 is a top plan view of the first configuration of the insert as shown in FIG. 3 and having equipment and accessories retained in the insert.

As seen in FIGS. 3-11, the insert 80 can have a plurality of dividers 96 disposed within the insert to define compartments 98. These compartments 98 can be configured to accommodate a particular sport or activity. The compartments 98 defined in the insert 80 can be waterproof or draining. For example, as seen in FIGS. 3 and 4, a configuration is provided for accommodating a kickboard, towel, swim buoy, goggles, and water bottle as well as additional accessories such as ear plugs or portable music devices.

Figure 5:
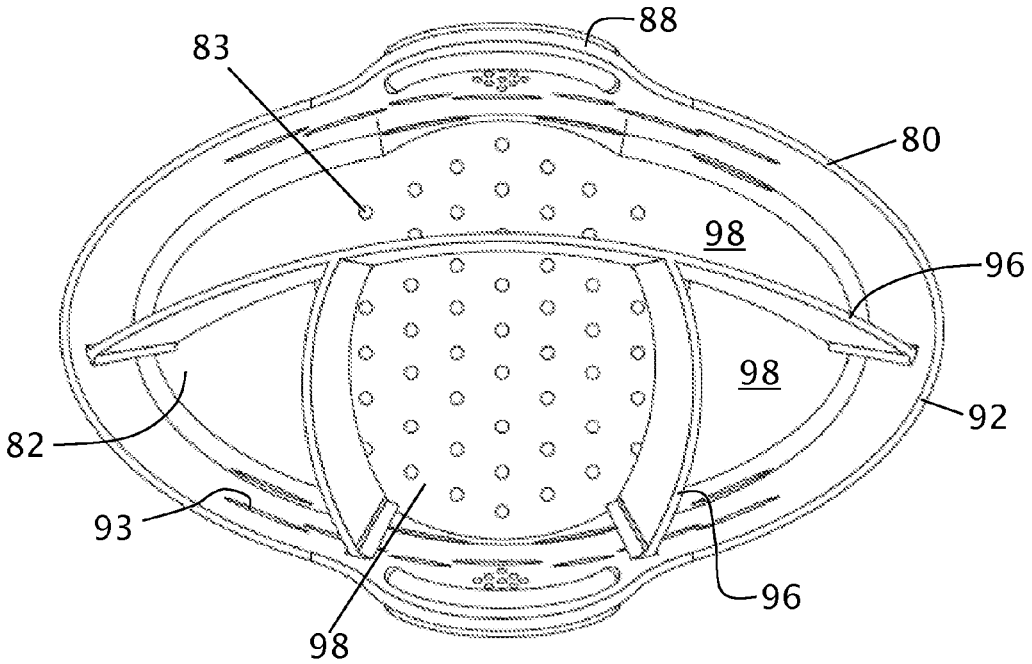
FIG. 5 is a top plan view of a second configuration of the insert.
Figure 6:
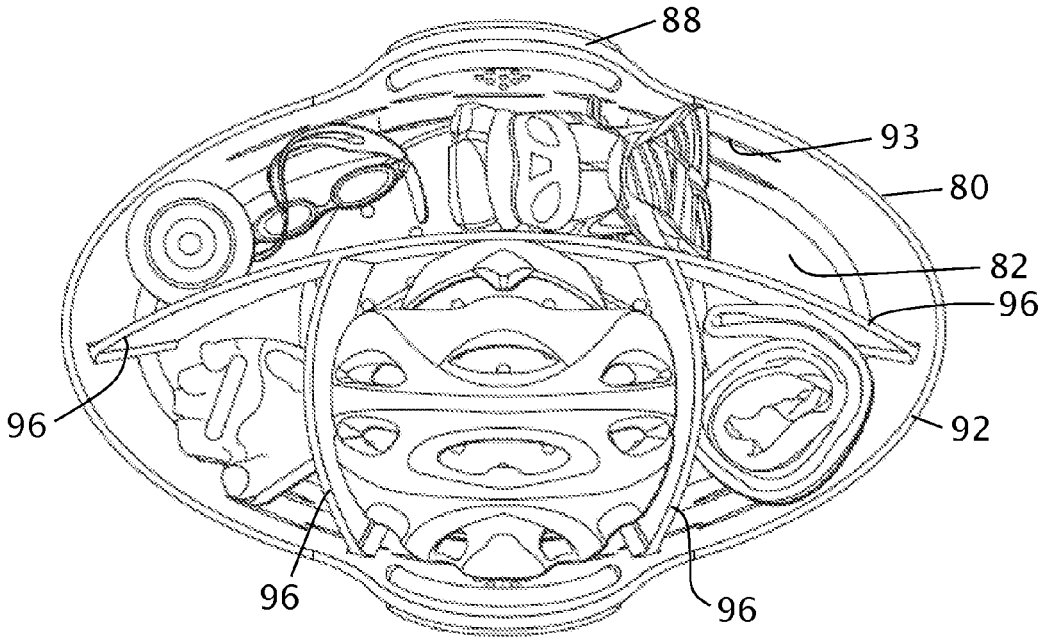
FIG. 6 is a top plan view of the second configuration of the insert as shown in FIG. 5 and having equipment and accessories retained in the insert.

Referring to FIGS. 5 and 6, a triathlon configuration is shown of the insert wherein the dividers 96 define a compartment 98 for receiving a helmet as well as swim gear and footwear.

Figure 7:
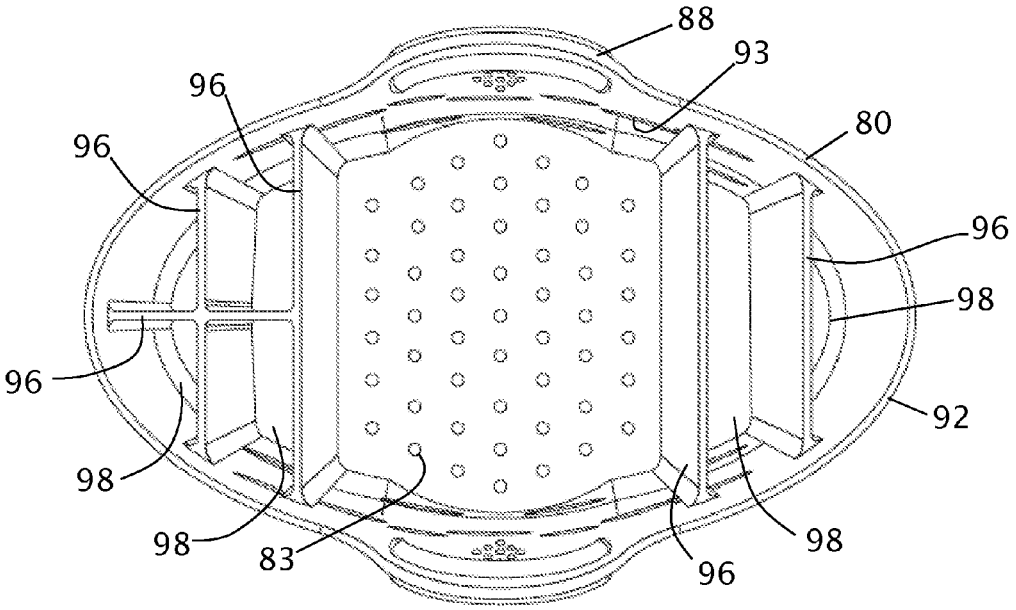
FIG. 7 is a top plan view of a third configuration of the insert.
Figure 8:
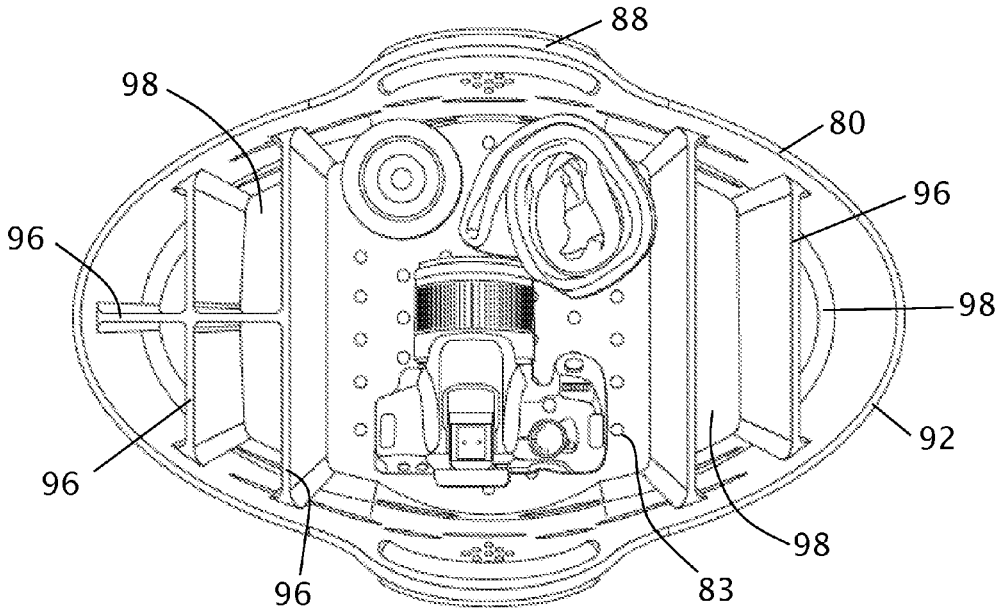
FIG. 8 is a top plan view of the third configuration of the insert as shown in FIG. 7 and having equipment and accessories retained in the insert.

Referring to FIGS. 7 and 8, a travel or beach configuration of the insert 80 and dividers 96 is shown wherein the dividers can define a substantially dry compartment that does not incorporate any apertures of the insert sidewall 90 or apertures of the insert bottom 82.

The dividers 96 are either integrally formed or engaged with an inside surface of the insert sidewall 90 to form a substantially waterproof seal or barrier. Thus, dry compartments can be provided within the insert 80 and hence tote assembly 10.

Similarly, compartments 98 can be provided with only ventilation through the insert sidewall 90 or through the insert sidewall as well as the apertures in the insert bottom 82.

Thus, a user could wash out or hose down the central compartment 98 as shown in FIG. 7 without wetting the adjacent and dry side compartments.

Figure 9:
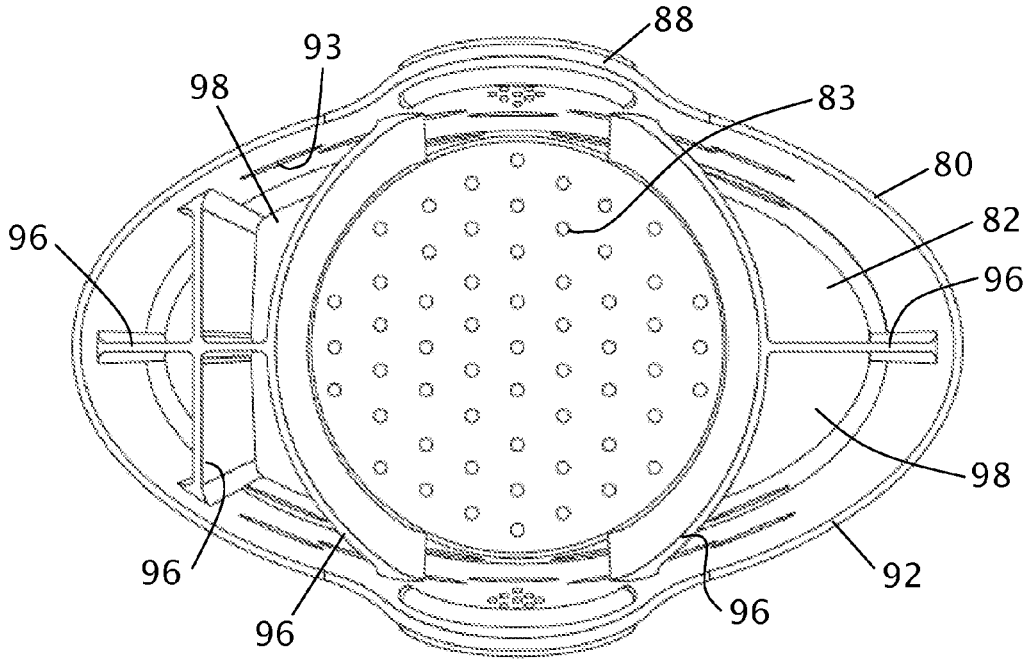
FIG. 9 is a top plan view of a fourth configuration of the insert.
Figure 10:
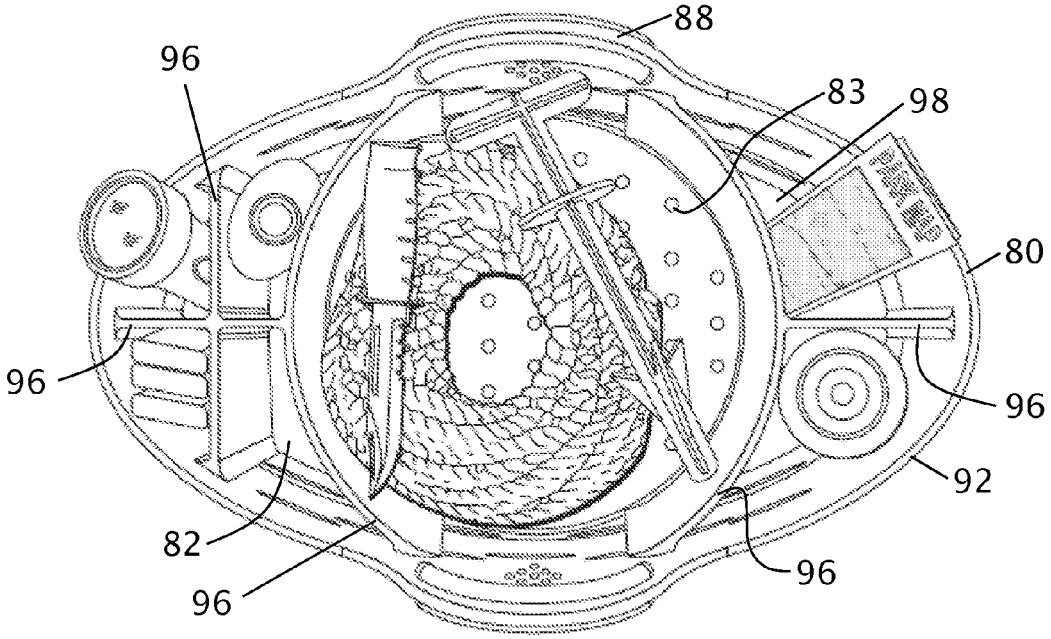
FIG. 10 is a top plan view of the fourth configuration of the insert as shown in FIG. 9 and having equipment and accessories retained in the insert.

Referring to FIGS. 9 and 10, the insert 80 is shown having yet another set of compartments 98 defined by the dividers 96.

Figure 12:
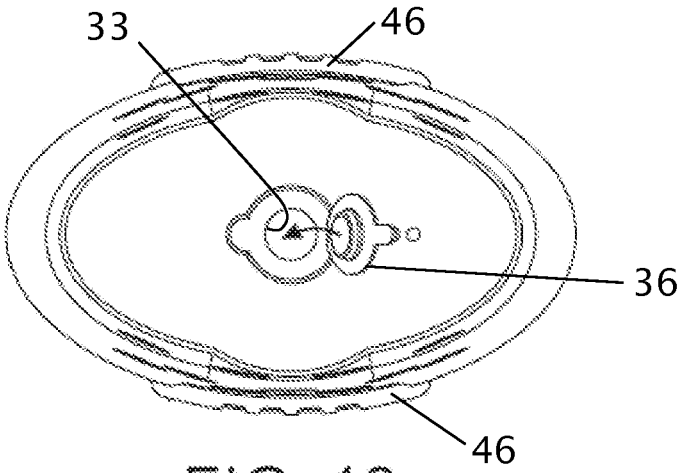
FIG. 12 is a bottom plan view of the basket showing a drain port in an open configuration.

FIGS. 11 and 12 disclose the insert 80 operably engaged with the basket 20 and the drain port 33 in the bottom of the basket is open.

More specifically, referring to FIG. 13, an enlarged view of the operably engaged insert 80 and basket 20 showing water passing through the holes 83 in the insert bottom 82 to collect in the reservoir 87 defined by the standoffs 86 and then to pass from the drain port 33 in the basket bottom 30.

As seen in one configuration, the drain port 33 is recessed from an adjacent surface of a bottom plane of the insert bottom 30 such that, upon operable engagement of the drain plug 36 with the drain port, a flat surface is formed.

It is further contemplated the baskets 20 can be customized to a given organization or entity wherein logos or names are provided on the basket.

Further, it is contemplated the tote assembly 10 can encompass a kit configuration having a single basket 20 and a plurality of inserts 80, wherein the respective insert can be packed with the selected gear and immediately readily located within the basket, with the basket securely closed and transported and used as necessary.

For example, for the swim configuration, the swimmer would dispose the wet suit, towel and goggles within the insert 80 within the basket 20. Upon returning home, the insert 80 is readily removed by engaging the grips 94 and removing the insert from the basket. As the insert 80 is self-standing, the insert is allowed to rest upon a support surface such as floor or a shelf and air continues to circulate through the suit and goggle area. The basket 20 can be drained, either by the drain port 33, or pouring out any collected water, and is then ready to accommodate an alternative insert.

Referring to FIGS. 14-20 show a further configuration of the tote assembly 10, wherein the insert 80 and the basket 20 engage in an alternative engagement.

Figure 20:
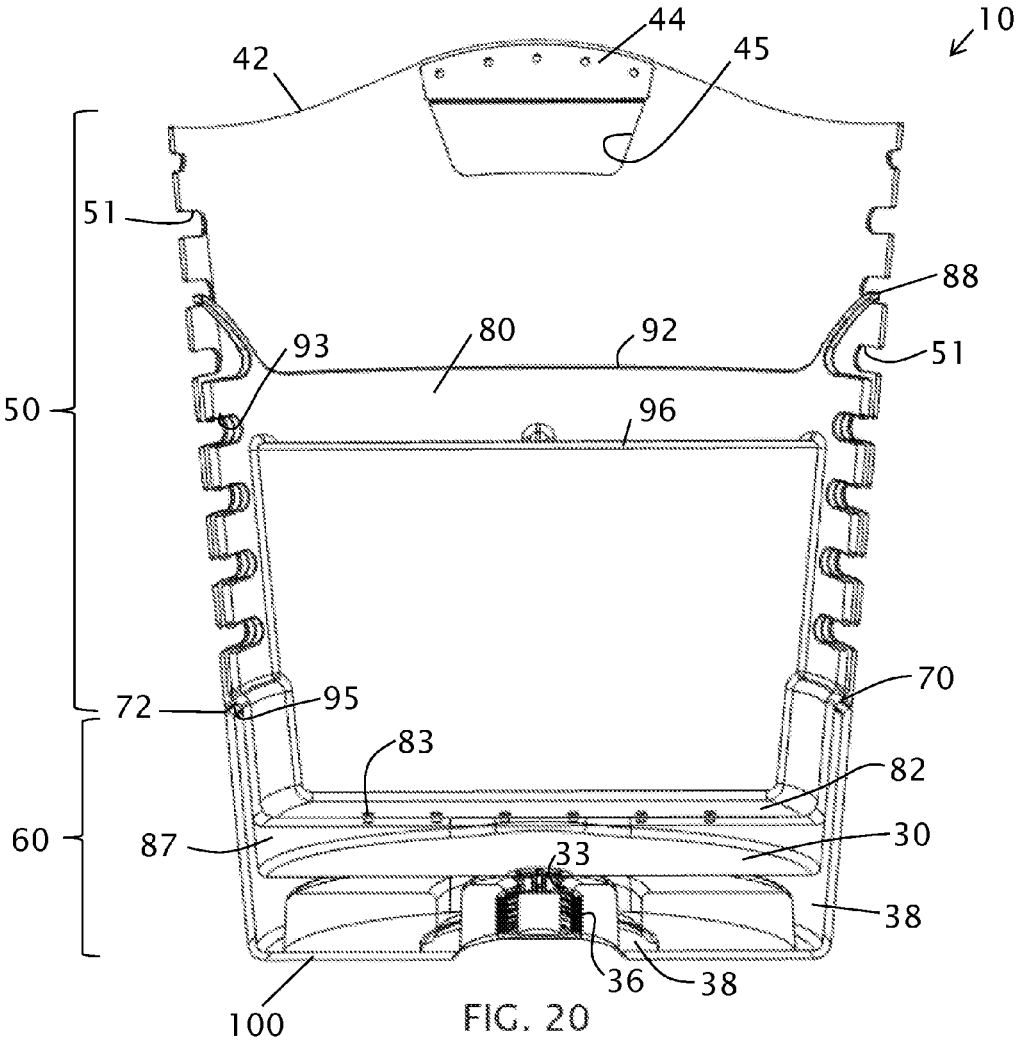
FIG. 20 is a cross sectional view of the tote assembly of FIG. 14.

As seen in FIG. 20, in the further configuration, the basket sidewall 40 can include an inwardly projecting ledge 70 located at a height between the basket bottom 30 and the free edge 42. In one embodiment, the inwardly projecting ledge 70 is located at a transition between the basket sidewall upper portion 50 and the basket sidewall lower portion 60. The ledge 70 can be formed by a bend or inflection in the basket sidewall 40 or by additional material projecting from an adjacent portion of the basket sidewall. Thus, the basket sidewall 40 can be provided with a thickness such that the inwardly projecting ledge 70 creates a corresponding outwardly projecting lip 72. Similarly, the lip 72 can be formed by a bend or inflection in the basket sidewall 40 or by removed material relative to an adjacent portion of the basket sidewall 40.

While both the ledge 70 and the lip 72 are shown as extending substantially continuously about the periphery of the basket sidewall 40, it is understood either one or both of the ledge and the lip can be defined by a plurality of discrete ledge or lip portions.

As set forth above, the free edge 42 of the basket sidewall 40 defines a generally elliptical or oval periphery having the major axis and the perpendicular minor axis, wherein the handles 44 are located on the minor axis for movement of the handles and sidewall generally perpendicular to the major axis. The apertures 51 in the basket sidewall 50 can be located on the major axis. That is, the apertures 51 can be located as seen in FIGS. 14-17 to be on the narrow ends of the basket 20, thereby providing increased area on the basket sidewall portion for labelling or displays. This location of the apertures 51 provides a relatively large uninterrupted area on the sidewall for supporting logos and printed indicia.

In this configuration of the tote assembly 10, an outside surface of the basket bottom 30 includes a plurality of feet or standoffs 38, seen in FIG. 20. While the standoffs 38 are configured to render the basket 20 self-supporting in an upright orientation, in certain configurations, the standoffs need not be restricted to providing the self-supporting upright orientation.

The standoffs 38 are configured and sized to provide a recess or pocket for the drain port 33 and the drain plug 36. Thus, the drain port 33 and the drain plug 36 are disposed within a vertical dimension of the standoffs 38.

Referring to FIGS. 14, 15, 16, 19 and 20, the basket 20 or basket bottom 30 can include a shoe 100 which slideably receives the basket sidewall lower portion and encloses the standoffs 38 on the outside surface of the bottom. The shoe 100 includes an aperture corresponding to the drain port 33 in the basket 20.

The shoe 100 can have a generally cup shape, wherein an upper periphery of the shoe is sized to seat against the outward lip 72 of the basket sidewall 40. In one configuration, the thickness of the shoe 100 is selected to match a radial dimension of the lip 72 such that a substantially continuous surface is provided.

As the shoe 100 can be a separate component, the shoe 100 can be formed of a variety of materials, such as but not limited to a rubberized elastomer which provides resistance to scuffing and tearing. Further, the rigidity of the shoe 100 can be greater than the basket sidewall 40 and/or the insert sidewall 90, as majority of deformation to provide for closure of the tote assembly 10 is created in the sidewalls.

In this configuration, it is contemplated the basket sidewall upper portion 50 is the same material than the basket sidewall lower portion 60 and the basket bottom 30. Thus, the basket sidewall upper portion 50, the basket sidewall lower portion 60 and the basket bottom 30 may be a pliable, self-supporting plastic, while the shoe 100 is a rubberized material, typically of a greater density and rigidity than the basket 20. While it is understood the shoe 100 can formed of a flexible pliable elastomer that allows the shoe to be removably engaged with the basket, it is contemplated the shoe 100 is affixed to the basket 20 to preclude non-destructive separation. Thus, the shoe 100 can be bonded, glued or welded to the basket 20.

The insert 80 in this configuration includes the apertures 93 as set forth above, wherein the apertures are located to align with the apertures 51 in the basket 20. That is, the apertures 93 can be located to be intersected by the major axis.

Figure 16:
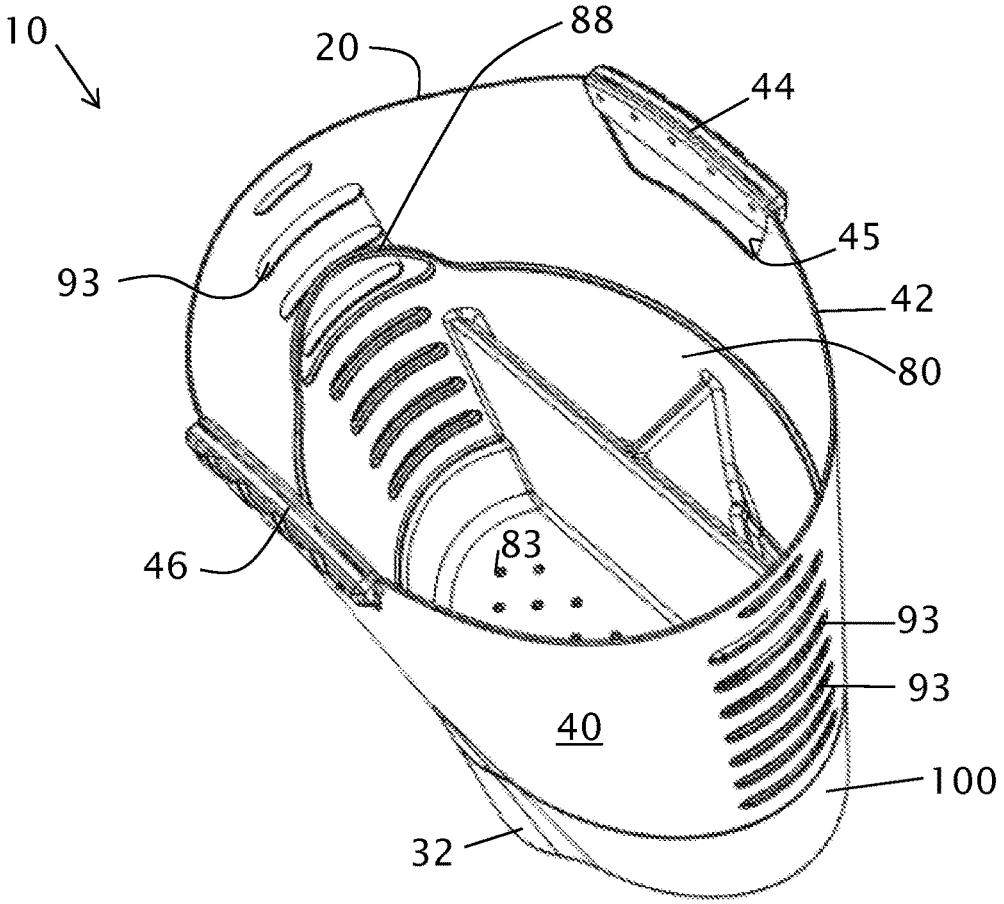
FIG. 16 is a perspective view of the further configuration of the tote assembly.

As seen in FIGS. 16 and 20, the handles 88 of the insert 80 can be perpendicular located to the handles 44 of the basket 20. That is, the handles 88 can be opposing and spaced along the major axis and the handles 44 of the basket can be opposed and spaced along the minor axis.

Figure 18:
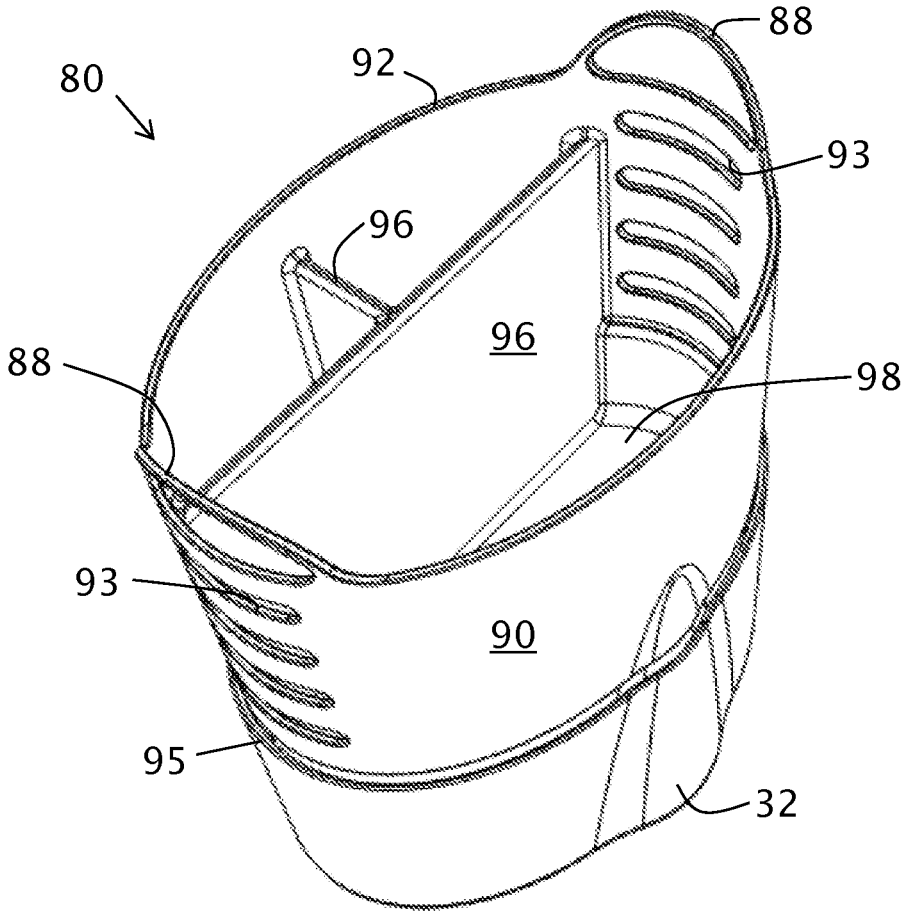
FIG. 18 is a perspective view of an insert of the further configuration of the tote assembly.
Figure 19:
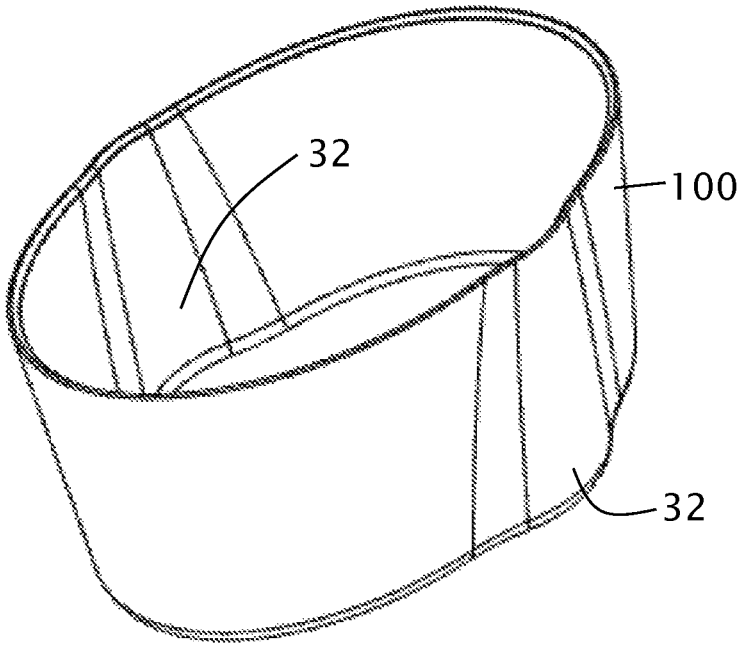
FIG. 19 is a perspective view of a shoe of the further configuration of the tote assembly.

As seen in FIG. 18, the insert sidewall 90 can include a peripheral shoulder 95 spaced a vertical distance from the insert bottom 82. The peripheral shoulder 95 is sized to engage the ledge 70 to set the position of the insert 80 relative to the basket 20 upon operable engagement. Thus, by having the vertical distance from the basket bottom 30 to the ledge 70 greater than the vertical distance from the insert bottom 82 to the shoulder 95, upon engagement of the shoulder 95 and the ledge 70, the reservoir 87 is formed between an upper surface of the basket bottom 30 and a lower surface of the insert bottom 82. The reservoir 87 is sized to retain the anticipated volume of liquid that may pass through the holes 83 in the insert bottom 30. The reservoir 87 can then be drained by removing the drain plug 36 from the drain port 33.

In one configuration, the basket 20 and the insert 80 are configured to permit the selective closure of the free edge of the basket sidewall 40. That is, the basket sidewall 40 and insert sidewall 90 are selected permit sufficient deformation to allow the handles 44 or releasable fasteners to engage and close the tote assembly 10.

It will be appreciated that variants of the above-disclosed and other features and functions, or alternatives thereof, may be combined into many other different systems or applications. Various presently unforeseen or unanticipated alternatives, modifications, variations, or improvements therein may be subsequently made by those skilled in the art which are also intended to be encompassed by the following claims.

The invention claimed is:

1. A tote assembly comprising:

(a) a basket having a basket bottom and a basket sidewall projecting from a periphery of the basket bottom and terminating at a basket open end, the basket sidewall including a plurality of basket apertures, the basket sidewall having a basket sidewall upper portion and a basket sidewall lower portion, the basket bottom and the basket sidewall lower portion formed of a water resistant material, the basket sidewall upper portion defining a pair of opposing handles, each handle at least partly defined by a corresponding handle aperture, the basket bottom and the basket sidewall configured to maintain an upright free standing orientation;

(b) an insert sized to be slidably received within the basket to be disposed in operable engagement with the basket, the insert including an insert bottom having a plurality of apertures and an insert sidewall projecting from a periphery of the insert bottom, the insert sidewall terminating at an insert open end and including a plurality of insert apertures, the insert apertures being aligned with the basket apertures upon operable engagement of the insert and the basket; and (c) a plurality of magnets to releasably retain the basket handles in a closed position.

2. The tote assembly of claim 1, wherein the insert sidewall includes an insert sidewall upper portion having a first rigidity and an insert sidewall lower portion having a different second rigidity.

3. The tote assembly of claim 1, wherein the insert sidewall defines a pair of opposing grips.

4. The tote assembly of claim 1, wherein the insert bottom and the insert sidewall are configured to maintain an upright free standing orientation.

5. The tote assembly of claim 1, wherein an outside surface of the insert bottom includes a shoulder and the basket sidewall includes an inwardly projecting ledge configured to contact the shoulder upon operable engagement of the insert and the basket.

6. The tote assembly of claim 1, wherein the insert sidewall is sized to locate an upper edge of the insert sidewall below the handle apertures of the basket sidewall upon operable engagement of the insert and the basket.

7. The tote assembly of claim 1, further comprising at least one divider in the insert, the divider extending from a first connection with the insert sidewall to a spaced second connection with the insert sidewall.

8. The tote assembly of claim 7, wherein the first connection and the second connection preclude water penetration.

9. The tote assembly of claim 1, wherein the basket bottom periphery includes a plurality of lobes.

10. The tote assembly of claim 1, wherein the insert bottom periphery includes a plurality of lobes.

11. The tote assembly of claim 1, wherein the basket sidewall upper portion has a first rigidity and the basket sidewall lower portion has a different second rigidity.

12. The tote assembly of claim 1, further comprising at least one divider in the insert, the divider extending from a first connection with the insert sidewall to a spaced second connection with the insert sidewall, wherein the divider creates at least two compartments within the insert.

13. The tote assembly of claim 1, further comprising at least one divider in the insert, the divider extending from a first connection with the insert sidewall to a spaced second connection with the insert sidewall, wherein the divider extends to between one half and approximately a height of the insert sidewall.

14. The tote assembly of claim 1, further comprising at least one divider in the insert, the divider extending from a first connection with the insert sidewall to a spaced second connection with the insert sidewall, wherein the divider extends to approximately three quarters a height of the insert sidewall.

15. The tote assembly of claim 1, wherein the divider forms a waterproof barrier with an adjacent portion of the insert sidewall.

16. The tote assembly of claim 1, wherein the basket bottom includes a drain port and a drain plug for selectively closing the drain port.

17. The tote assembly of claim 1, wherein the basket open end has a continuously curvilinear periphery and the periphery of the basket bottom has intersecting curvilinear portions.

18. The tote assembly of claim 1, wherein the insert open end has a continuously curvilinear periphery and the periphery of the insert bottom has intersecting curvilinear portions.

19. The tote assembly of claim 1, wherein the insert bottom includes a first portion including the plurality of apertures and a second portion free of apertures.

20. The tote assembly of claim 1, further comprising an inwardly projecting ledge in the basket and a shoulder on the insert, wherein the ledge engages the shoulder to limit movement of the insert in basket.

* * * * *